US008774664B2

(12) United States Patent
Koshida

(10) Patent No.: US 8,774,664 B2
(45) Date of Patent: Jul. 8, 2014

(54) IMAGE FORMING APPARATUS WITH LOOP DETECTION AND CONVEYANCE SPEED CONTROL

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 1162 days.

(21) Appl. No.: 11/745,701

(22) Filed: May 8, 2007

(65) Prior Publication Data

US 2007/0264033 A1 Nov. 15, 2007

(30) Foreign Application Priority Data

May 15, 2006 (JP) ..... 2006-135891

(51) Int. Cl.
*G03G 15/00* (2006.01)

(52) U.S. Cl.
CPC .... *G03G 15/657* (2013.01); *G03G 2215/00413* (2013.01); *G03G 2215/00628* (2013.01); *G03G 2215/00784* (2013.01)
USPC ..... 399/68; 399/400

(58) Field of Classification Search
CPC ..... G03G 2215/00784; G03G 2215/00628; G03G 2215/00413
USPC ..... 399/68, 400; 400/579; 271/242, 258.01, 271/265.01, 183, 176
See application file for complete search history.

(56) References Cited

U.S. PATENT DOCUMENTS

| | | | | |
|---|---|---|---|---|
| 6,564,025 | B2 | 5/2003 | Sameshima et al. | 399/68 |
| 6,892,038 | B2 * | 5/2005 | Fukutani | 399/68 |
| 2003/0156853 | A1 * | 8/2003 | Fukutani | 399/68 |
| 2006/0051116 | A1 * | 3/2006 | Koshida | 399/68 |

FOREIGN PATENT DOCUMENTS

| | | |
|---|---|---|
| JP | 5-107966 | 4/1993 |
| JP | 7-234604 | 9/1995 |
| JP | 10-097154 | 4/1998 |
| JP | 2000-344385 | 12/2000 |
| JP | 2001-282072 | 10/2001 |
| JP | 2003-345150 | 12/2003 |
| JP | 2006-023655 | 1/2006 |
| JP | 2006-227481 A | 8/2006 |

OTHER PUBLICATIONS

Hayakawa, Yasuyoshi; Komatsu, Teruo Japanese Patent No. JP403023150A Title: Sheet Material Discharge Device Publication date: Jan. 31, 1991 English Abstract.*

* cited by examiner

*Primary Examiner* — Judy Nguyen
*Assistant Examiner* — Jennifer Simmons
(74) *Attorney, Agent, or Firm* — Fitzpatrick, Cella, Harper & Scinto

(57) ABSTRACT

A sheet which entered between a first sheet conveying unit and a second sheet conveying unit is detected by a sheet detecting unit. A loop of the sheet formed with a difference of sheet conveying speeds between the first and second sheet conveying units is detected by a loop detecting sensor. After the sheet detecting unit detected the sheet, if the loop detecting sensor does not detect the loop, a control unit which controls the sheet conveying speed of at least one of the first and second sheet conveying units controls the sheet conveying speed of at least one of the first and second sheet conveying units, thereby reducing an amount of the formed loop.

8 Claims, 20 Drawing Sheets

(TIMER 14 ON)

(Ts)

(Tf)

(Tq2)

(Te)

IMAGE FORMING APPARATUS WITH LOOP DETECTION AND CONVEYANCE SPEED CONTROL

BACKGROUND OF THE INVENTION

1. Field of the Invention

The present invention relates to an image forming apparatus and, more particularly, to a technique for conveying a sheet while forming a loop.

2. Description of the Related Art

Hitherto, in an image forming apparatus of one of an electrophotographic system and an electrostatic recording system, after a toner image was transferred onto a sheet, the sheet is conveyed to a fixing unit and the toner image is heated, pressed, and fixed by the fixing unit, thereby forming an image onto the sheet.

According to such an image forming apparatus, the sheet onto which the toner image formed by an image forming unit has been transferred passes through the fixing unit, is conveyed to a discharging unit, and is discharged from the image forming apparatus by the discharging unit. Among the image forming apparatuses, there is an apparatus in which after the toner image formed on a photosensitive drum was primarily transferred onto an intermediate transfer belt, it is transferred onto the sheet by a secondary transfer unit.

FIGS. 20A and 20B illustrate an example of a construction of a conventional image forming apparatus. In FIGS. 20A and 20B, a full color image formed on an intermediate transfer belt 131 is transferred onto a sheet P by a secondary transfer unit 130. In the secondary transfer unit 130, toner images of four colors on the intermediate transfer belt 131 are transferred in a lump onto the sheet P by a secondary transfer bias which is applied to a secondary transfer roller 132.

Subsequently, the sheet P onto which the toner images have been transferred as mentioned above is guided by conveying guides 140 and 141 provided between the secondary transfer unit 130 and a fixing roller pair 150. The sheet P is conveyed to the fixing roller pair 150 constructed by a fixing roller 152 and a pressing roller 151. Toner of respective colors is heated and pressed by the fixing roller pair 150, so that the toner is fused, color-mixed, and fixed as a full-color image onto the sheet P. After that, the sheet P on which the image has been fixed is discharged by a discharging roller pair 160 provided downstream of the fixing roller pair 150.

When the sheet P is conveyed from the secondary transfer unit 130 to the fixing roller pair 150, if a sheet conveying speed of the fixing roller pair 150 is higher than that of the secondary transfer unit 130 (secondary transfer roller 132), the sheet P is pulled by the fixing roller pair 150. When the sheet P is pulled, transfer noises (disturbance of an image upon transfer) are generated and a deviation of a copying magnification occurs.

Therefore, hitherto, the sheet conveying speed of the fixing roller pair 150 is set to be slightly lower than that of the secondary transfer unit 130 and a loop is formed in a conveying path 170 between the secondary transfer unit 130 and the fixing roller pair 150, thereby preventing the generation of the transfer noises or the like.

In FIGS. 20A and 20B, a heater 153 is provided in the fixing roller 152. Temperature control is made by the heater 153 so that a surface temperature of the fixing roller 152 is equal to a predetermined fixing temperature.

Quality of the image formed on the sheet P by the image forming apparatus having such a construction changes by one of a heat energy and a pressure energy which are received from the fixing roller pair 150. Particularly, in a color image which is formed by depositing a large amount of toner onto the sheet P, picture quality and glossiness are liable to be influenced by the heat energy and the pressure energy which are received from the fixing roller pair 150 as compared with the case of a black and white (monochromatic) image on which a toner deposition amount is small.

In the case of continuously executing the image forming operation, there is a case where the heat energy lost by the fixing process of one sheet is not sufficiently recovered and the fixing process of the next sheet is started in the state where the surface temperature of the fixing roller 152 decreased. In such a case, the picture quality also deteriorates.

As a countermeasure against the deterioration of the picture quality that is caused by the decrease in surface temperature of the fixing roller 152, hitherto, an electric power which is supplied to the heater 153 is increased (heater capacitance is increased). In this case, when considering an interval of a relatively long time, the supplied energy and the consumed energy can be balanced.

However, even in the case of taking such a countermeasure, if a material such as a heat resistant rubber or the like whose heat response performance is low is used for the surface of the fixing roller 152 in order to improve the picture quality, there is a case where the temperature of the fixing roller 152 decreases temporarily.

When the temperature of the fixing roller 152 decreases as mentioned above, an outer diameter of the fixing roller 152 changes due to such a temperature change. The conveying speed of the sheet P which passes through the fixing roller pair 150 changes. The picture quality and the conveying speed of the sheet also change depending on a difference of the heat capacitance of the sheet P, that is, a sheet type such as thin sheet, thick sheet, OHP film, or the like.

When the sheet conveying speed of the fixing roller pair 150 further decreases due to the temperature decrease of the fixing roller 152, a large loop is formed between the fixing roller pair 150 and the secondary transfer unit 130. When the large loop is formed as mentioned above, particularly, in the case of the image forming unit in which a distance between the secondary transfer unit 130 and the fixing roller pair 150 is small, as shown in FIG. 20B, the image surface of the sheet P is come into contact with the conveying guide 141 and is rubbed, so that a defective image and the transfer noises (disturbance of the image upon transfer) occur.

To solve such a problem, there is an apparatus in which the sheet conveying speed of the fixing roller pair (fixing unit) 150 is controlled by the first speed lower than the sheet conveying speed of the secondary transfer unit (transfer unit) 130 and by the second speed higher than the first speed.

When the sheet conveying speed of the fixing roller pair 150 is controlled by the first speed, in the case where a height of the sheet loop which is formed between the fixing roller pair 150 and the secondary transfer unit 130 is equal to a predetermined height or more, the speed is switched to the second speed. When the height of the sheet loop is equal to the predetermined height or less, the sheet conveying speed of the fixing roller pair 150 is switched to the first speed. In this manner, a size of sheet loop which is formed between the fixing roller pair 150 and the secondary transfer unit 130 is maintained within a predetermined range.

The techniques of switching the sheet conveying speed as mentioned above have been disclosed in Japanese Patent Application Laid-Open Nos. H05-107966, H07-234604, H10-097154, 2000-344385, 2001-282072, 2003-345150, and 2006-23655.

An example of the loop control will now be described with reference to FIGS. 20A and 20B. A flag 162 is arranged in the conveying path 170 between the secondary transfer unit 130 and the fixing roller pair 150. When the sheet P forms a loop, the flag 162 rotates around a rotary axis 161 as a rotational center by a pressure of the sheet P. A rotational angle of the flag 162 which changes depending on the loop of the sheet P is detected by a sensor 163. The loop control at the first speed and the second speed of the fixing roller pair 150 is made based on a detection signal from the sensor 163, thereby stabilizing the loop of the sheet P.

In the conventional image forming apparatus in which such a loop control is made, it is presumed that the loop which is formed in the sheet P between the transfer unit and the fixing unit has a loop shape in such an orientation that the surface on which the non-fixed toner of the sheet P is not transferred becomes a convex surface (hereinafter, such a loop is called a normal loop) as shown in FIG. 20A. That is, by inclining a nip direction of the secondary transfer unit 130 and a nip direction of the fixing roller pair 150 at a predetermined angle, the normal loop in such an orientation that the non-image surface side of the sheet P becomes a convex surface is formed.

However, in the case of a sheet on which a large amount of toner has been deposited upon creation of the image of the first plane, for example, in a duplex image forming mode, there is a case where the sheet is largely curled so as to become a concave shape toward the toner surface side after the fixing. In such a case, upon image creation of the second plane, there is a case where the sheet is conveyed in the state where the sheet is curled so that the surface on which the non-fixed toner has been transferred becomes a convex surface between the transfer unit and the fixing unit. When the sheet P is left in a high-temperature and high-humidity environment, there is a case where a large curl is caused by a difference between a moisture absorption situation of the moisture on the obverse surface of the sheet and that on the reverse surface. Depending on the obverse/reverse side of the curled sheet P which is set onto a sheet feeding tray, there is a case where the sheet is conveyed in the curled state so that the surface on which the non-fixed toner has been transferred becomes the convex surface between the transfer unit and the fixing unit.

After the image was transferred by the secondary transfer unit 130 onto the sheet in which such a curl that the surface on which the non-fixed toner is transferred becomes the convex surface had occurred as mentioned above and the sheet entered the fixing roller pair 150, if the loop control is made, there is a case where the sheet enters a state as shown in FIG. 20B. That is, such a loop shape that the surface on which the non-fixed toner has been transferred becomes the convex surface (hereinafter, such a loop is called a reverse loop) occurs suddenly. If such a reverse loop occurs, since the flag 162 does not light-shield the sensor 163, the sensor 163 cannot detect the sheet P. Therefore, since the detection signal is not input from the sensor 163, a control unit (not shown) erroneously determines that a loop amount of the sheet P is small.

If such an erroneous determination is made, the control unit continuously supplies a signal instructing that the sheet conveying speed of the fixing roller pair 150 is set to the first speed lower than that of the secondary transfer unit 130 so as to further increase the loop amount. Thus, an amount of reverse loop increases and the image surface side of the sheet P is soon come into contact with the guide 141 on the side opposite to the sensor 163. The non-fixed toner on the sheet is rubbed. Thus, the defective image of the sheet occurs.

According to the invention disclosed in, for example, Japanese Patent Application Laid-Open No. 2006-23655, a sheet attracting unit for attracting the sheet in the orientation of the loop which is detected by a loop detecting unit is provided between the transfer unit and the fixing unit and an attracting force of the sheet by the sheet attracting unit is set to a value within a range where the reverse loop of the sheet can be eliminated.

However, when presuming the case where a large curled sheet whose image surface side becomes the convex surface is conveyed, an apparatus whose attracting force is very large has to be arranged in order to eliminate the reverse loop, resulting in an increase in size and costs of the apparatus. Moreover, if the attracting force is set to be too large, there is also a case where the toner in the apparatus is scattered, the sheet itself vibrates, and a trouble of the defective image occurs. Further, in order to solve such a problem, if the transfer unit and the fixing unit are arranged so that the image surface side is difficult to become the convex surface, there is such a problem that a degree of freedom upon designing of a layout construction of the conveying path and the whole apparatus decreases.

SUMMARY OF THE INVENTION

The invention is, therefore, made in consideration of such circumstances and the invention provides a sheet conveying apparatus and an image forming apparatus, in which an increase in size of the apparatus can be avoided and a curled sheet can be conveyed at low costs without causing a defective image.

According to the invention, there is provided an image forming apparatus comprising: a first sheet conveying unit which conveys a sheet; a second sheet conveying unit which is provided downstream of the first sheet conveying unit and conveys the sheet; a loop detecting unit which detects the sheet whose loop is formed between the first sheet conveying unit and the second sheet conveying unit; and a control unit which controls a sheet conveying speed of at least one of the first sheet conveying unit and the second sheet conveying unit, wherein based on the detection of the loop detecting unit, the control unit controls the sheet conveying speed so as to convey the sheet while forming the loop between the first sheet conveying unit and the second sheet conveying unit, and when a presumption time at which it is presumed that the loop detecting unit detects the sheet whose loop is formed elapses, if the loop detecting unit does not detect the sheet, the control unit controls the sheet conveying speed so as to reduce an amount of the loop which is formed in the sheet.

Further features of the present invention will become apparent from the following description of exemplary embodiments with reference to the attached drawings.

DESCRIPTION OF THE EMBODIMENTS

An exemplary embodiment for embodying the invention will be described in detail hereinbelow with reference to the drawings.

Figure 1:
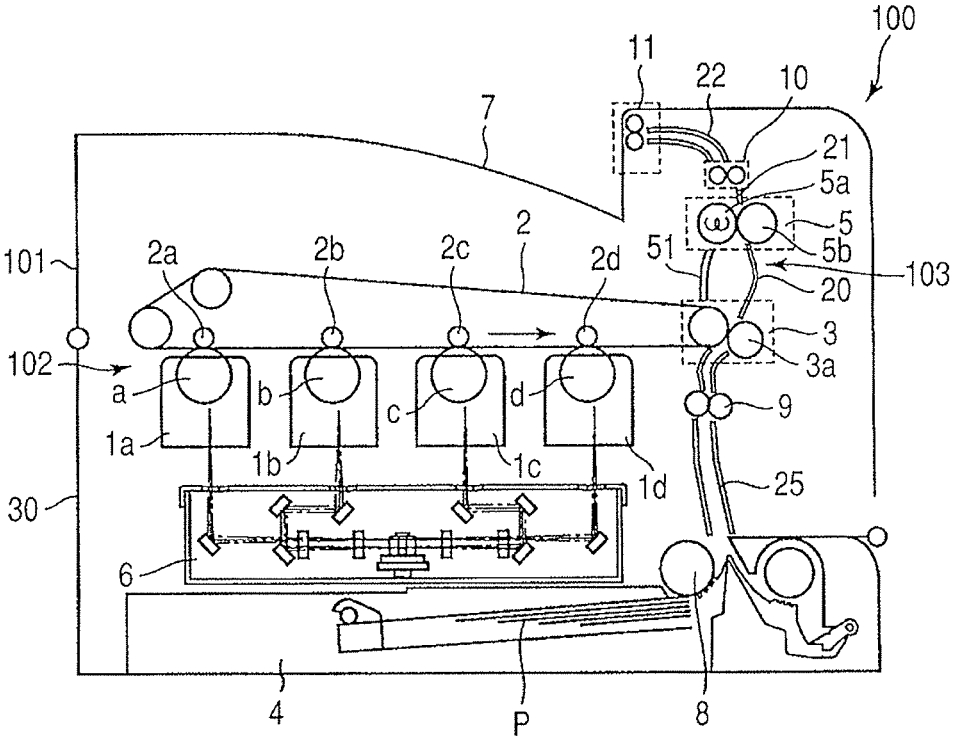
FIG. 1 is a diagram illustrating a construction of an image forming apparatus having a sheet conveying apparatus according to the first embodiment of the invention.

FIG. 1 is a diagram illustrating a construction of an image forming apparatus having a sheet conveying apparatus according to the first embodiment of the invention. An image forming apparatus 100 has an image forming apparatus main body (hereinbelow, referred to as an apparatus main body) 101, an image forming unit 102 which forms an image onto a sheet, and a fixing roller pair 5 as a fixing unit are illustrated.

The image forming unit 102 has: photosensitive drums a to d for forming toner images of four colors of yellow, magenta, cyan, and black; an exposing apparatus 6 for forming electrostatic latent images onto the photosensitive drums by irradiating a laser beam based on image information; and the like. The photosensitive drums a to d are driven by motors (not shown). Although not illustrated, primary charging units, developing units, and transfer charging units are arranged around the photosensitive drums and they are constructed as units called process cartridges 1*a* to 1*d*, respectively.

An intermediate transfer belt 2 is rotated in the direction shown by an arrow. By applying a transfer bias to the intermediate transfer belt 2 by transfer charging units 2*a* to 2*d*, the toner images of the respective colors on the photosensitive drums are sequentially multiple-transferred onto the intermediate transfer belt 2. Thus, a full-color image is formed on the intermediate transfer belt.

A secondary transfer unit 3 transfers the full-color image sequentially formed on the intermediate transfer belt 2 onto the sheet P. A discharging roller pair 11 as a discharging unit discharges the sheet P on which the image has been fixed by the fixing roller pair 5 onto a discharge tray 7. A sheet conveying apparatus 103 conveys the sheet on which the toner image has been transferred by the secondary transfer unit 3 to the discharging roller pair 11 as a discharging unit through the fixing roller pair 5.

The image forming operation of the image forming apparatus 100 constructed as mentioned above will now be described.

When the image forming operation is started, first, the exposing apparatus 6 irradiates the laser beam based on the image information which is transmitted from a personal computer (not shown) or the like and sequentially exposes the surfaces of the photosensitive drums a to d whose surfaces have uniformly charged to a predetermined polarity and a predetermined electric potential, thereby forming electrostatic latent images onto the photosensitive drums. After that, the electrostatic latent images are developed and visualized by toner.

For example, first, the laser beam based on an image signal of a yellow component color of the original is irradiated onto the photosensitive drum a through a polygon mirror or the like of the exposing apparatus 6, thereby forming the yellow electrostatic latent image onto the photosensitive drum a. The yellow electrostatic latent image is developed by yellow toner from the developing unit, thereby visualizing as a yellow toner image.

Subsequently, in association with the rotation of the photosensitive drum a, when the toner image reaches a first transfer unit where the photosensitive drum a and the intermediate transfer belt 2 are come into contact with each other, the yellow toner image on the photosensitive drum a is transferred to the intermediate transfer belt 2 by the primary transfer bias applied to the transfer charging unit 2*a* (primary transfer).

Subsequently, when the portion which holds the yellow toner image on the intermediate transfer belt 2 is moved, a magenta toner image formed on the photosensitive drum b until this point of time by a method similar to that mentioned above is transferred to the intermediate transfer belt 2 on the yellow toner image. Similarly, as the intermediate transfer belt 2 is moved, the cyan toner image and the black toner image are overlaid and transferred onto the yellow toner image and the magenta toner image by the primary transfer unit. Thus, a full-color toner image is formed on the intermediate transfer belt 2.

In parallel with the toner image forming operation, the sheets P enclosed in a sheet feeding cassette 4 are picked up and fed one by one by a pickup roller 8 and reach a registration roller 9. After timing was matched by the registration roller 9, the sheets are conveyed to the secondary transfer unit 3. In the secondary transfer unit 3, the toner images of the four colors on the intermediate transfer belt 2 are transferred onto the sheet P in a lump by a secondary transfer bias which is applied to a secondary transfer roller 3*a* as a transfer unit (secondary transfer).

Subsequently, the sheet P on which the toner images have been transferred as mentioned above is guided by conveying guides 20 and 51 provided between the secondary transfer unit 3 and the fixing roller pair 5 and conveyed to the fixing roller pair 5 constructed by a fixing roller 5*a* and a pressing roller 5*b*. By the fixing roller pair 5, the toner of the respective colors is heated and pressed, so that the toner is fused, color-mixed, and fixed as a full-color image onto the sheet P. After that, the sheet P to which the image has been fixed is discharged onto the discharge tray 7 by the discharging and conveying roller pair 11 provided downstream of the fixing roller pair 5.

Figure 2:
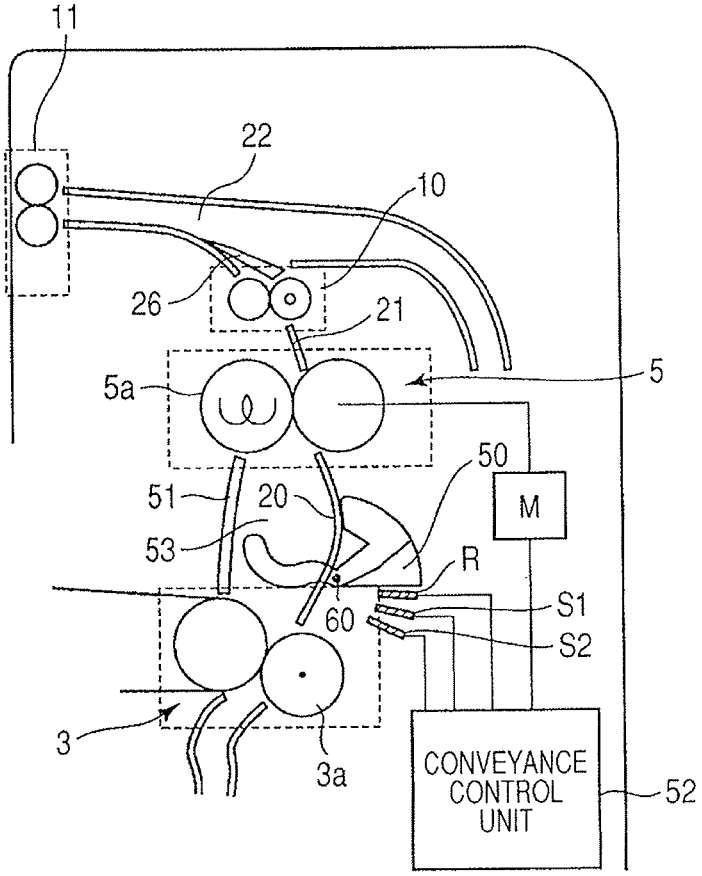
FIG. 2 is an enlarged diagram of a main section of the image forming apparatus.

As illustrated in FIG. 2, a flag 50 is arranged in a conveying path 53 between the secondary transfer unit 3 and the fixing roller pair 5 and the conveying path 53 is constructed by the conveying guides 20 and 51. When the sheet P passes, the flag 50 is pressed by the sheet P and is rotated around a rotary axis 60 as a rotational center.

A fixing entrance sensor R as a sheet detecting unit for detecting the sheet P which entered the conveying path 53 is arranged around the flag 50. A first loop detecting sensor S1 and a second loop detecting sensor S2 which are detecting units for the loop control for detecting the loop of the sheet P which is formed in the conveying path 53 due to a difference between the sheet conveying speed of the secondary transfer unit 3 (secondary transfer roller 3*a*) and that of the fixing roller pair 5 are also arranged.

Figure 3A:
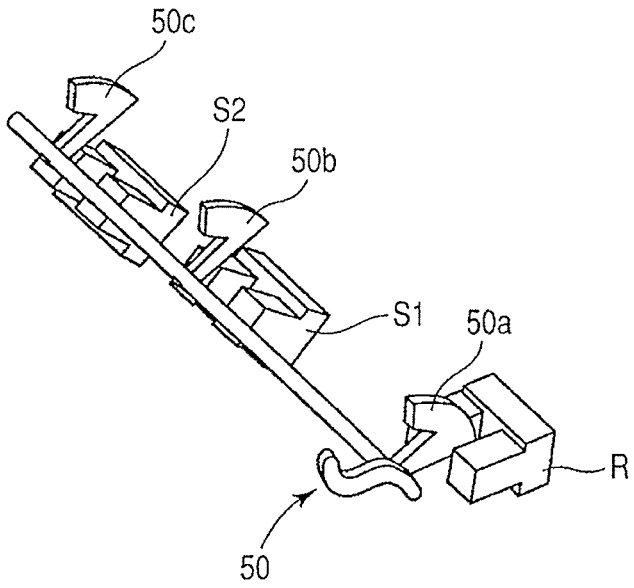
FIGS. 3A and 3B are diagrams for describing a layout of three sensors provided in the image forming apparatus.
Figure 3B:
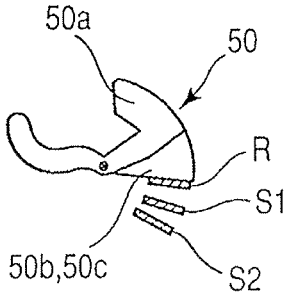

FIGS. 3A and 3B are diagrams for describing a layout of the three sensors R, S1, and S2. As illustrated in FIG. 3A, the flag 50 has a first light shielding portion 50*a*, a second light shielding portion 50*b*, and a third light shielding portion 50*c* each for light-shielding the fixing entrance sensor R, first loop detecting sensor S1, and second loop detecting sensor S2. In the embodiment, as illustrated in FIG. 3B, the second light shielding portion 50*b* and the third light shielding portion 50*c* are provided for the flag 50 at the same phase. The three sensors R, S1, and S2 are arranged at different phases.

As illustrated in FIG. 2, the three sensors R, S1, and S2 are connected to a conveyance control unit 52 as a control unit. A fixing motor M which can drive the fixing roller pair 5 independent of other conveying roller pairs and whose rotational speed can be changed is attached to the conveyance control unit 52.

Figure 4:
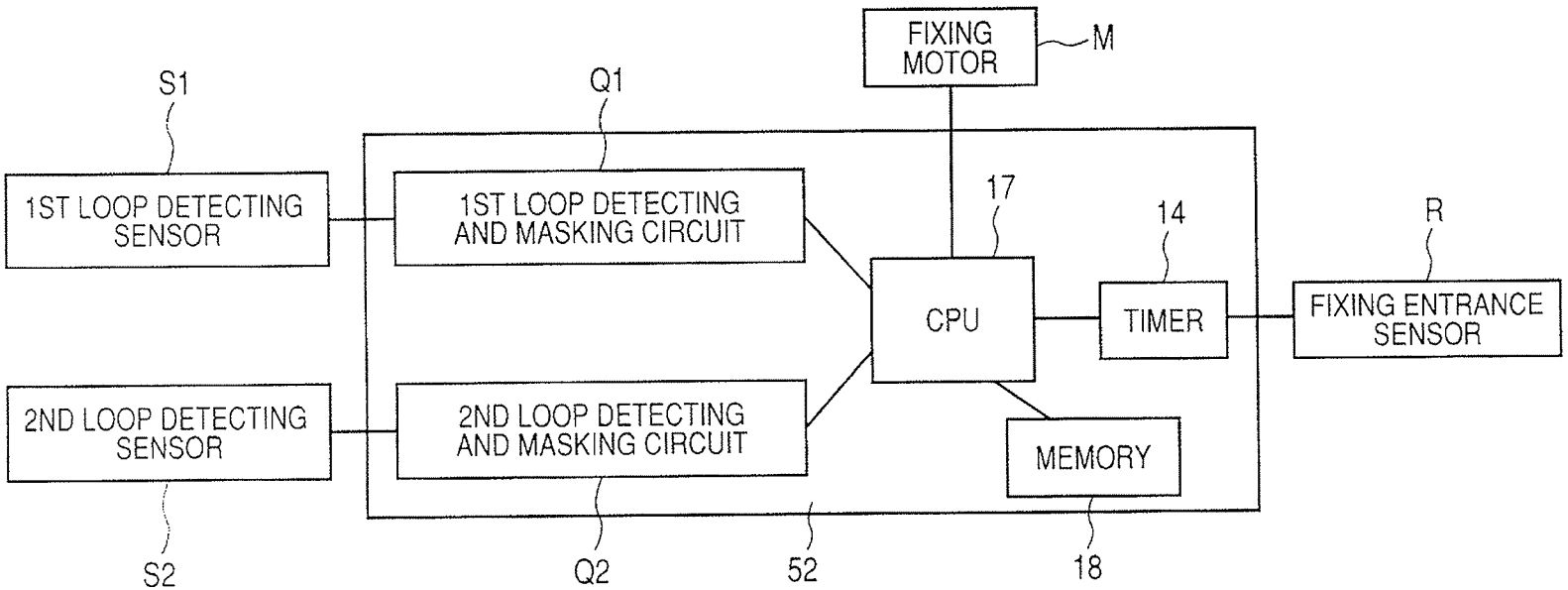
FIG. 4 is a control block diagram of a conveyance control unit provided in the image forming apparatus.

FIG. 4 is a control block diagram of the conveyance control unit 52. The conveyance control unit 52 has a CPU 17, a memory 18 which is used as one of an area for temporarily storing control data such as a control program and the like and a work area of an arithmetic operation accompanied with the control, and a timer 14.

In FIG. 4, a first loop detecting and masking circuit Q1 and a second loop detecting and masking circuit Q2 selectively input detection signals from the first loop detecting sensor S1 and the second loop detecting sensor S2 to the CPU 17. When the first and second loop detecting and masking circuits Q1 and Q2 are OFF, the apparatus enters the same state as the state where the signals from the first and second loop detecting sensors S1 and S2 are not input to the conveyance control unit 52 (CPU 17).

When the detection signal is input from the fixing entrance sensor R which has detected the sheet P, first, the conveyance control unit 52 (CPU 17) constructed as mentioned above starts the timer 14. Further, after that, the conveyance control unit 52 (CPU 17) controls the sheet conveying speed of the fixing roller pair 5 by controlling the rotational speed of the fixing motor M according to the signals from the first and second loop detecting sensors S1 and S2, thereby keeping the loop state of the sheet P constant between the secondary transfer unit 3 and the fixing roller pair 5.

The loop control operation of the conveyance control unit 52 as mentioned above will now be described.

Figure 5:
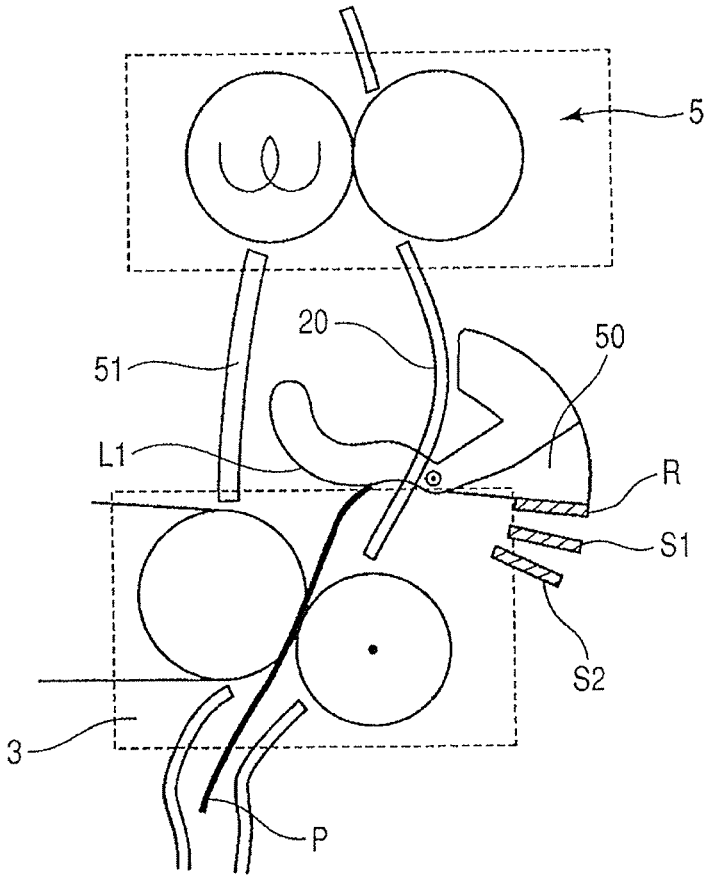
FIG. 5 is a diagram for describing the loop control operation of the conveyance control unit.

When the sheet P on which the toner images of the four colors on the intermediate transfer belt 2 have been transferred in a lump by the secondary transfer unit 3 as already mentioned above enters the conveying path 53, first, the flag 50 is pressed and rotated as illustrated in FIG. 5, thereby light-shielding the fixing entrance sensor R. When the fixing entrance sensor R is light-shielded as mentioned above, as shown in a flowchart of FIG. 6, the fixing entrance sensor R detects the sheet (S100). In association with the sheet detection, the conveyance control unit 52 starts the counting operation of the timer 14 (S101).

Subsequently, the sheet P reaches the fixing nip of the fixing roller pair 5 whose sheet conveying speed has been preset to a sheet conveying speed Vf1 (low speed) lower than a sheet conveying speed Vt of the secondary transfer unit 3. At this time, the rotational speed of the fixing motor M is equal to M1 as shown in (b) in a timing chart of FIG. 7.

Since the motion of a front edge of the sheet P is unstable while the sheet P reaches the fixing nip as mentioned above, the flag 50 vibrates finely according to the sheet P. Thus, the first and second loop detecting sensors S1 and S2 repeat the on/off operations as shown in (c) and (d) for a short time. Therefore, the first and second loop detecting and masking circuits Q1 and Q2 are turned off for such a period of time as shown in (e) and (f), thereby preventing the detection signals from the first and second loop detecting sensors S1 and S2 from being input to the conveyance control unit 52.

Thereafter, when the sheet P is nipped to the fixing roller pair 5, in the conveying path 53 between the secondary transfer unit 3 and the fixing roller pair 5, the loop is formed in the sheet P due to the difference between the sheet conveying speed of the secondary transfer unit 3 and that of the fixing roller pair 5. In this instance, generally, although the normal loop is formed in the sheet, there is also a case where the reverse loop is formed depending on the state of the curl of the sheet P.

Figure 7:
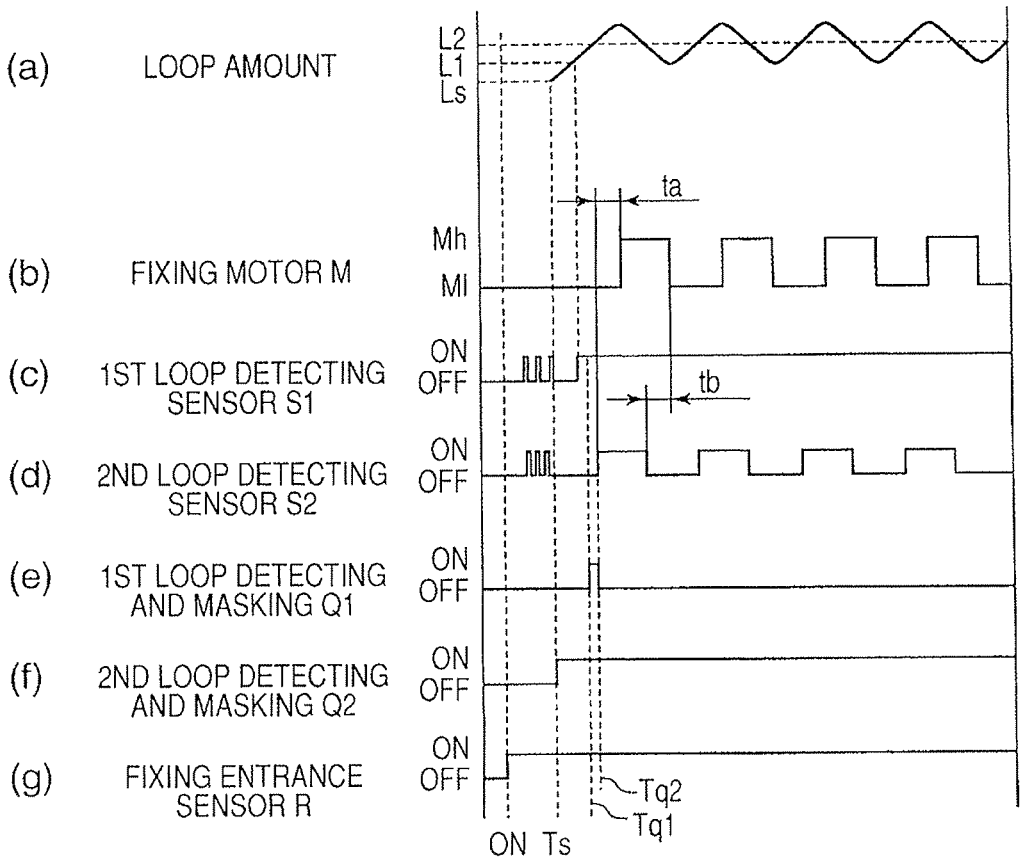
FIG. 7 is a timing chart for describing the loop control operation of the conveyance control unit.
Figure 8:
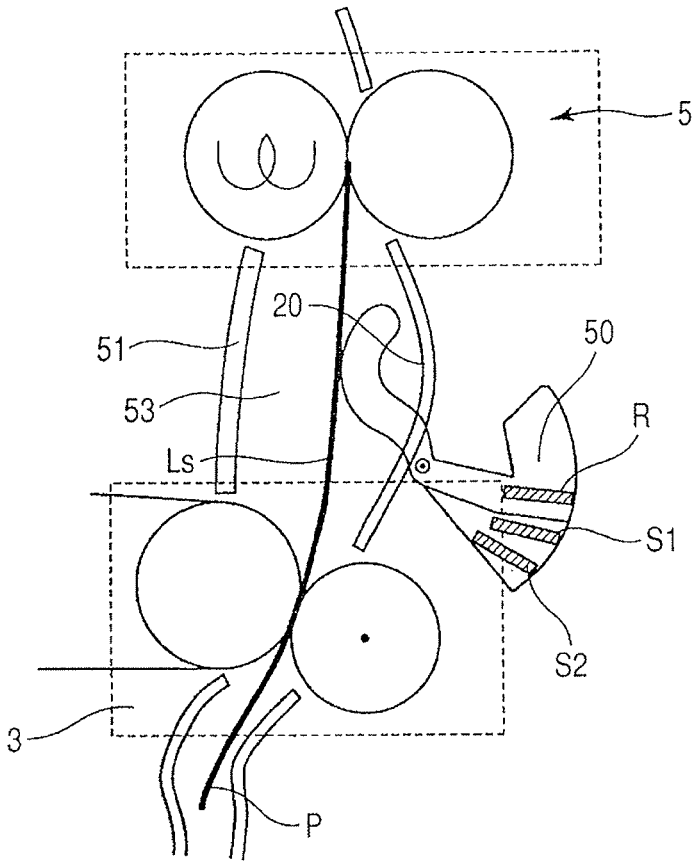
FIG. 8 is a first diagram for describing the loop control operation for a non-curled sheet which is executed by the conveyance control unit.

FIG. 8 is a diagram illustrating the state just after the non-curled sheet P was nipped to the fixing roller pair 5. In FIG. 8, the loop of the sheet P which is formed between the secondary transfer unit 3 and the fixing roller pair 5 is assumed to be Ls. A count value of the timer 14 at this time is assumed to be Ts. The second loop detecting and masking circuit Q2 is turned on at this timing or before or after this timing (refer to FIG. 7).

Figure 9:
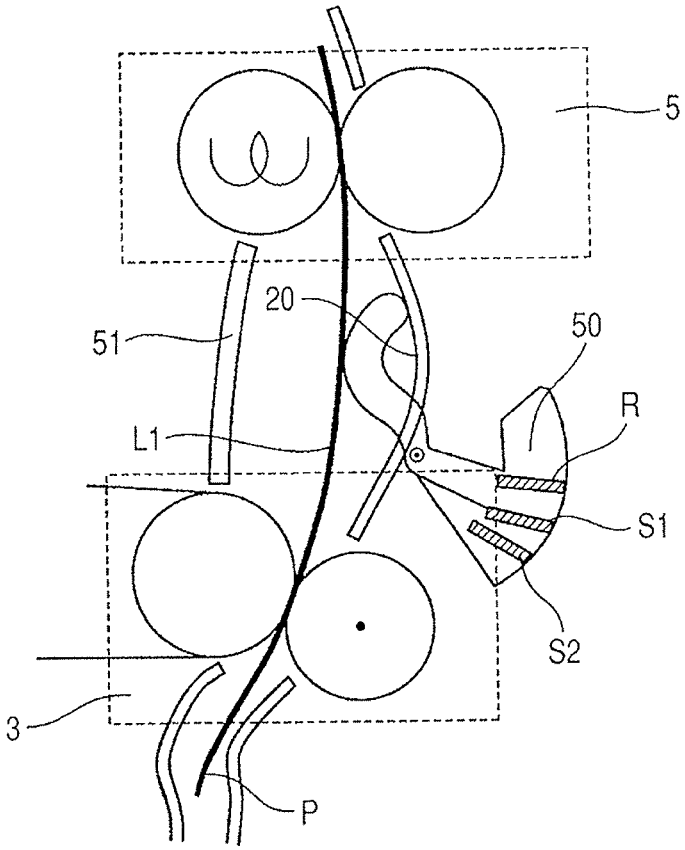
FIG. 9 is a second diagram for describing the loop control operation in the case of the non-curled sheet which is executed by the conveyance control unit.

After that, since a sheet conveying speed Vf of the fixing roller pair 5 has been preset to the speed Vf1 lower than the sheet conveying speed Vt of the secondary transfer unit 3, the sheet P gradually increases the loop and a length of loop soon reaches L1 as illustrated in FIG. 9.

At this time, as shown in (e) in FIG. 7, the first loop detecting and masking circuit Q1 is held in the OFF state. However, when the count value of the timer 14 reaches Tq1, the first loop detecting and masking circuit Q1 is held in the ON state until the count value reaches Tq2.

For this period of time (Tq1 to Tq2), when the first loop detecting sensor S1 outputs an ON signal, the ON signal is input to the conveyance control unit 52. Although the loop is continuously detected for the period of time (Tq1 to Tq2) for convenience of description of a masking interval in the embodiment, the loop can be also detected for a predetermined time from the turn-on of the timer 14, that is, from the turn-on of the fixing entrance sensor R. The period of time (Tq1 to Tq2) corresponds to the predicting time of the invention. That is, a time which is necessary until the count value passes through Tq1 and reaches Tq2 after the timer 14 started the counting operation is set to a reference which is used when discriminating whether the loop formed in the sheet is the normal loop or the reverse loop. If the first loop detecting sensor S1 is turned on within such a time, it is determined that the normal loop has been formed in the sheet. If it is OFF, it is determined that the reverse loop has been formed in the sheet.

Figure 6:
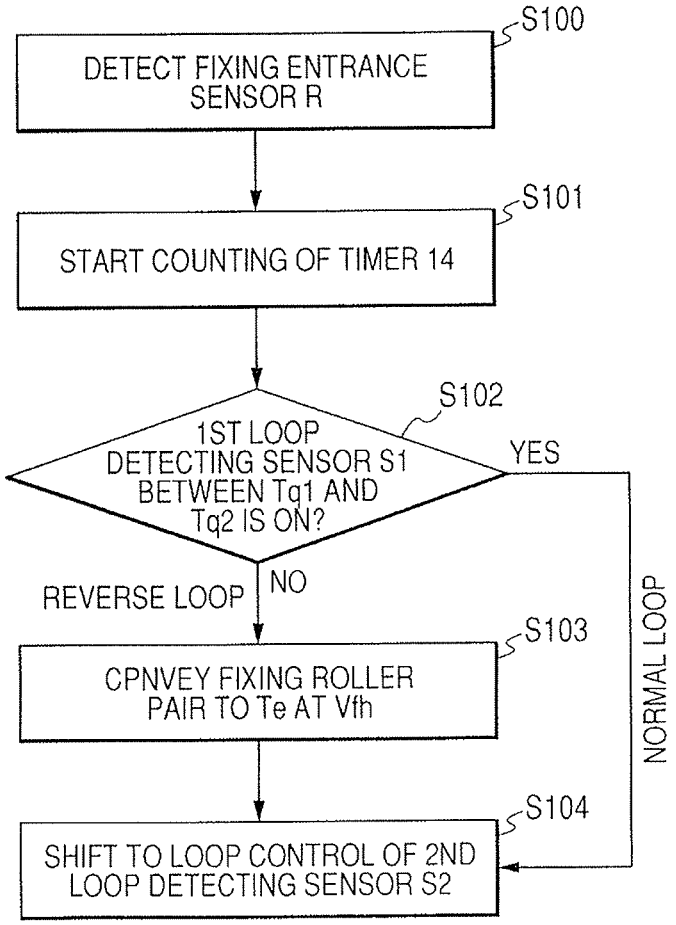
FIG. 6 is a flowchart for describing the loop control operation of the conveyance control unit.

As shown in the flowchart of FIG. 6, the conveyance control unit 52 discriminates whether or not the first loop detecting sensor S1 is ON for such a period of time (Tq1 to Tq2) (S102). As illustrated in FIG. 9, when the sheet P has formed the normal loop, the first loop detecting sensor S1 is ON.

If the first loop detecting sensor S1 is ON as mentioned above (YES in S102), the conveyance control unit 52 determines that the normal loop has been formed. Thereafter, the conveyance control unit 52 makes the loop control based on the signal from the second loop detecting sensor S2 (S104).

Figure 10:
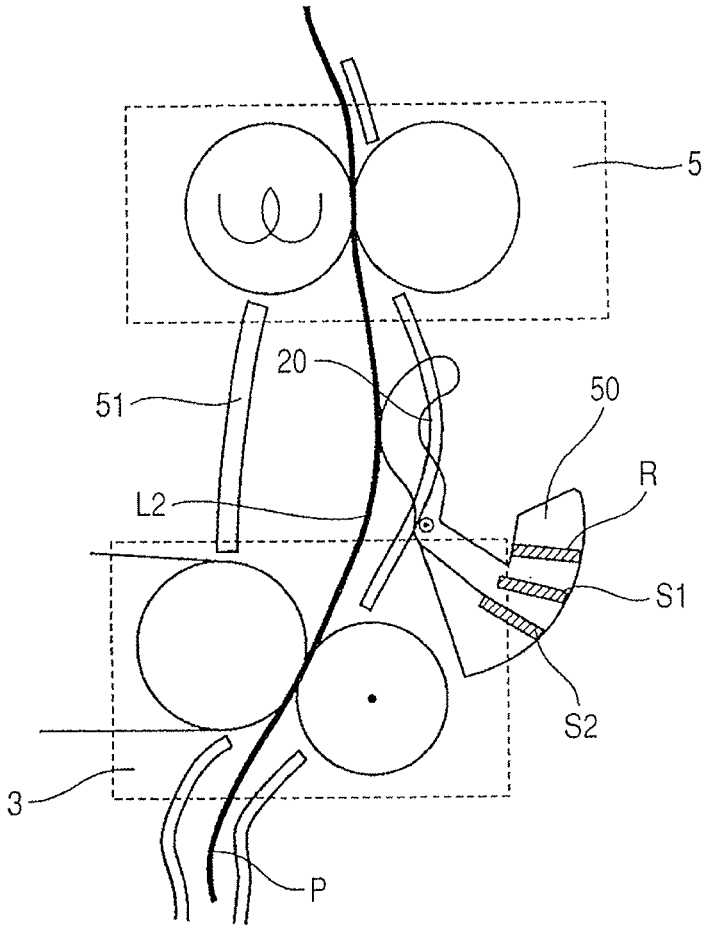
FIG. 10 is a third diagram for describing the loop control operation in the case of the non-curled sheet which is executed by the conveyance control unit.

Subsequently, as illustrated in FIG. 10, when the loop length of the sheet P between the secondary transfer unit 3 and the fixing roller pair 5 is equal to L2, the flag 50 further rotates. As illustrated in FIG. 10 and (d) in FIG. 7, the second loop detecting sensor S2 is turned on from the OFF state. At this time, as shown in (f) in FIG. 7, since the second loop detecting and masking circuit Q2 is ON, the conveyance control unit 52 fetches the signal information of the second loop detecting sensor S2.

After that, the fixing motor M is controlled based on the signal from the second loop detecting sensor S2. Thus, as shown in (b) in FIG. 7, after the elapse of a predetermined delay time ta, the rotational speed of the fixing motor M is switched to a rotational speed Mh at which the sheet conveying speed Vf of the fixing roller pair 5 is set to a speed Vfh (high speed) higher than the sheet conveying speed Vt of the secondary transfer unit 3.

After that, as illustrated in (d) in FIG. 7 and FIG. 9, the second loop detecting sensor S2 is switched to the OFF state. In response to the turn-off of the sensor S2, after the elapse of a predetermined delay time tb, the rotational speed of the fixing motor M is switched to a rotational speed M1 at which the sheet conveying speed of the fixing roller pair 5 is set to the speed Vf1 lower than the sheet conveying speed Vt of the secondary transfer unit 3.

By repeating such control, the loop amount of the sheet P between the secondary transfer unit 3 and the fixing roller pair 5 can be held to almost L2 as shown in (a) in FIG. 7 and the conveyance of the sheet P is stabilized.

Figure 11:
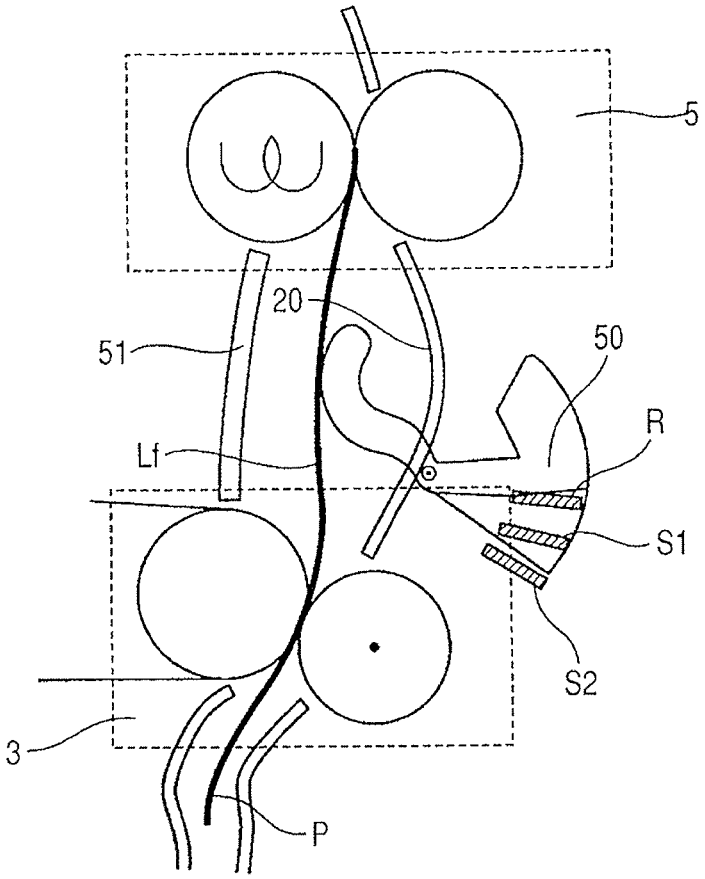
FIG. 11 is a fourth diagram for describing the loop control operation in the case of the non-curled sheet which is executed by the conveyance control unit.

On the other hand, for example, when the sheet P is curled or the like, in the state just after the sheet was nipped to the fixing roller pair 5, there is a case where a loop in the opposite orientation is formed as illustrated in FIG. 11. That is, a loop in such a shape that the non-image surface side is dented is formed in the sheet P. In FIG. 11, the loop of the sheet P which is formed between the secondary transfer unit 3 and the fixing roller pair 5 is assumed to be Lf. The count value of the timer 14 at this time is assumed to be Tf. As shown in (f) in FIG. 12, the second loop detecting and masking circuit Q2 is turned on before and after such timing.

After that, since the sheet conveying speed Vf of the fixing roller pair 5 has been preset to the speed Vf1 lower than the sheet conveying speed Vt of the secondary transfer unit 3, the sheet P gradually forms a large loop.

As mentioned above, the sheet P does not form the loop toward the side (normal loop) which is formed by a nip angle ϕ between the secondary transfer unit 3 and the fixing roller pair 5 but the loop is largely formed in the direction shown by an arrow Y while keeping the orientation of the loop Lf to the non-image surface.

Figure 12:
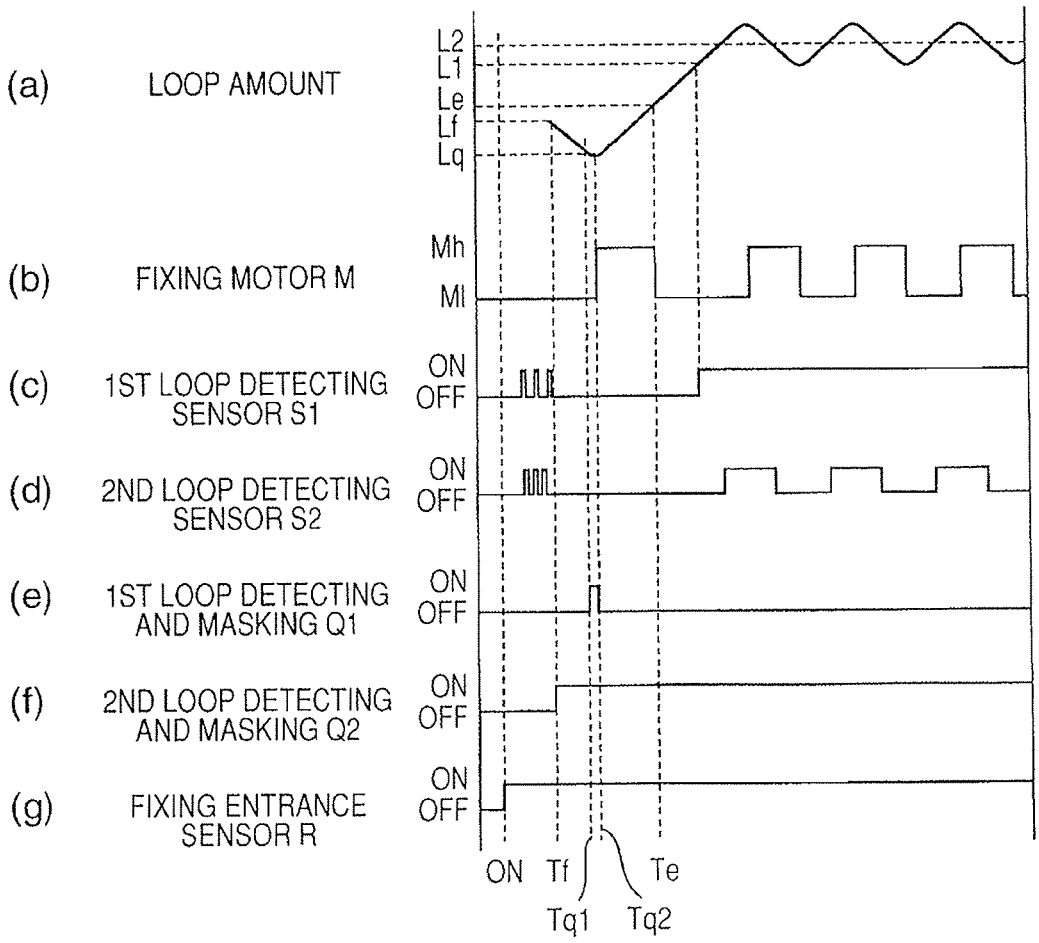
FIG. 12 is another timing chart for describing the loop control operation of the conveyance control unit.

On the other hand, although the first loop detecting and masking circuit Q1 is held in the OFF state as shown in (e) in FIG. 12, when the count value of the timer 14 at this time reaches Tq1, the first loop detecting and masking circuit Q1 is held in the ON state until the count value reaches Tq2. For such a period of time (Tq1 to Tq2), when the first loop detecting sensor S1 outputs an ON signal, this ON signal is input to the conveyance control unit 52.

Figure 14:
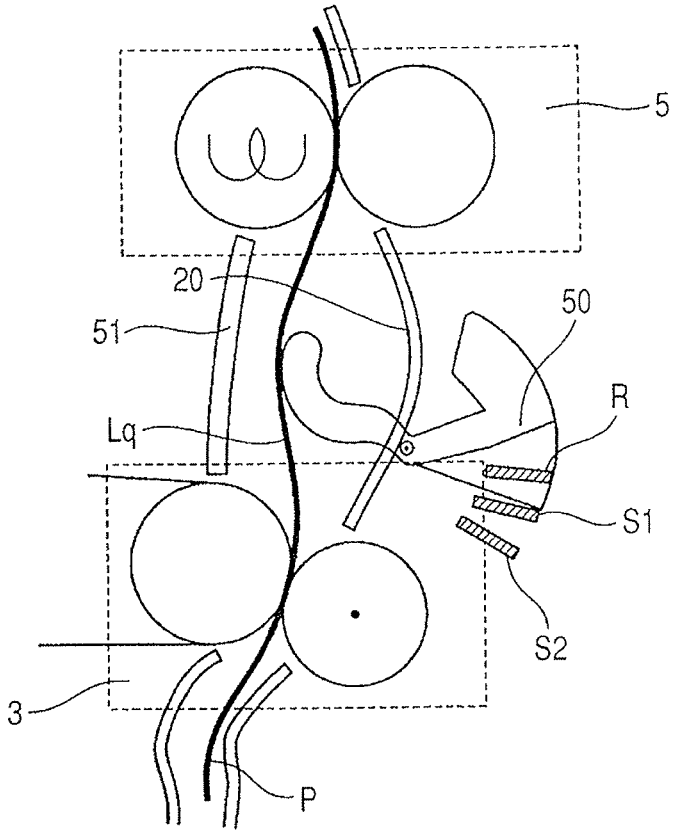
FIG. 14 is a second diagram for describing the loop control operation in the case of the curled sheet which is executed by the conveyance control unit.

However, if the sheet has formed the reverse loop, the first loop detecting sensor S1 is OFF as illustrated in FIG. 14. In this case, that is, when the first loop detecting sensor S1 is OFF (NO in S102) as shown in the flowchart of FIG. 6, the conveyance control unit 52 determines that the loop is the reverse loop. As shown in (b) in FIG. 12, the conveyance control unit 52 switches the rotational speed of the fixing motor M from the M1 to Mh.

When the rotational speed of the fixing motor M is switched to Mh as mentioned above, the sheet conveying speed of the fixing roller pair 5 increases from Vf1 to Vfh. After that, the sheet P is conveyed at the sheet conveying speed Vfh for a setting time Te as a recovery time of the invention from the timer 14 (S103). At this time, a condition of the set values of Tq1 and Tq2 is the timing when the first loop detecting sensor S1 is certainly turned on at the time of the normal loop. The values of Tq1 and Tq2 have been set in the memory 18. The setting time Te has previously been obtained by experiments or the like.

After the elapse of the setting time Te, the rotational speed of the fixing motor M is returned to M1. Thus, the sheet conveying speed Vf of the fixing roller pair 5 is again returned to the speed Vf1 (rotational speed M1 of the fixing motor M) lower than the sheet conveying speed Vt of the secondary transfer unit 3.

Figure 15:
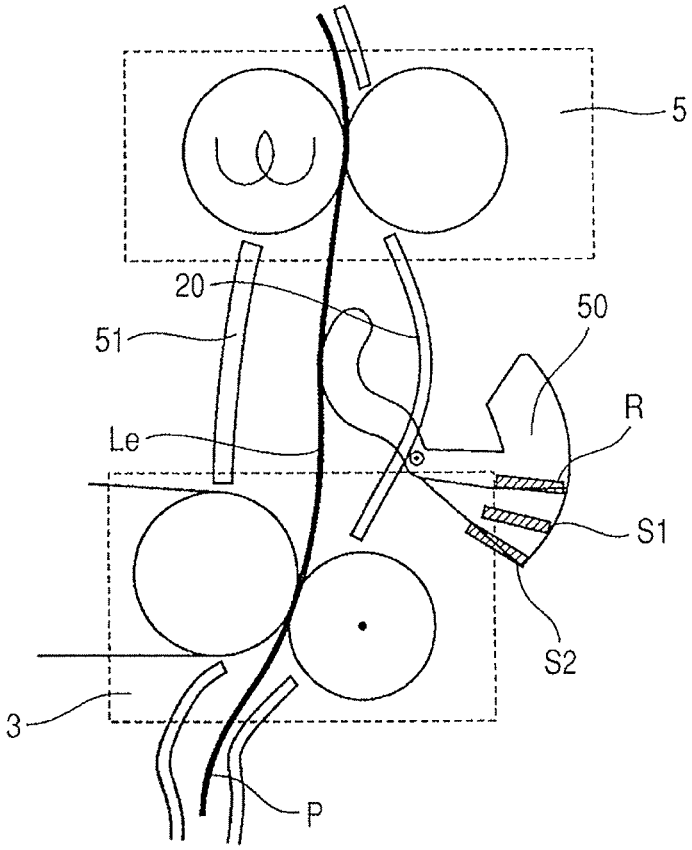
FIG. 15 is a third diagram for describing the loop control operation in the case of the curled sheet which is executed by the conveyance control unit.

If the sheet P is conveyed for the setting time Te at the sheet conveying speed Vfh higher than the sheet conveying speed Vt of the secondary transfer unit 3, the loop amount of the sheet P decreases. As illustrated in FIG. 15, a loop Le enters the state where the reverse loop is smaller than a loop Lf in the state of Tf illustrated in FIG. 11 mentioned above.

Figure 13:
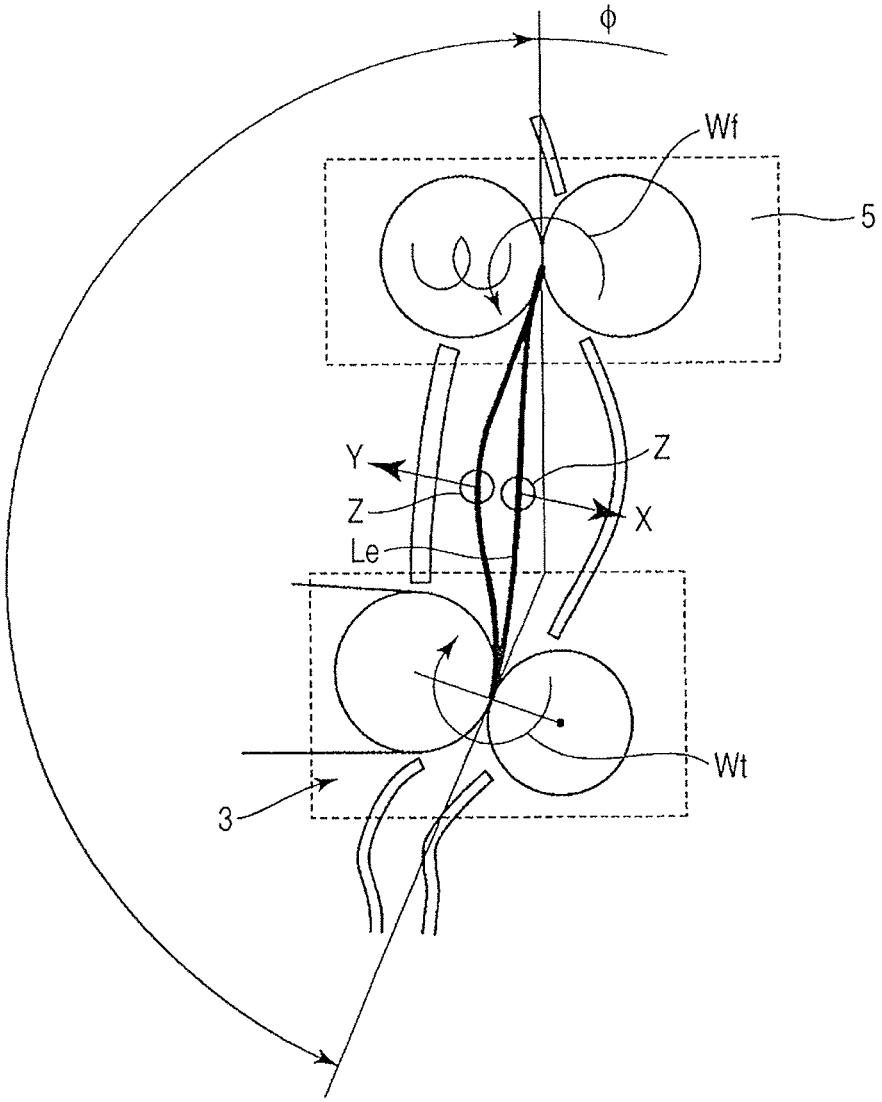
FIG. 13 is a first diagram for describing the loop control operation for a curled sheet which is executed by the conveyance control unit.

In the embodiment, as illustrated in FIG. 13 mentioned above, the secondary transfer unit 3 and the fixing roller pair 5 are arranged so that nip lines corresponding to their sheet conveying directions cross. Therefore, rotational moments Wt and Wf are applied to the sheet P in the state of the small reverse loop, respectively. Thus, in addition to that the loops are formed near the nips in the acting directions of the rotational moments Wt and Wf, a point Z of the sheet P is easily moved by the actions of the rotational moments Wt and Wf.

Therefore, when the sheet P is conveyed for the setting time Te at the sheet conveying speed Vfh, as illustrated in FIG. 13, the orientation of the loop of the sheet P can be reversed to the side (side shown by an arrow X) which is formed by the nip angle ϕ between the secondary transfer unit 3 and the fixing roller pair 5.

Consequently, the sheet P forms the normal loop. A condition of the set value of Te at this time is the timing of forming such a shallow reverse loop state that the loop can be reversed in the normal loop orientation without stretching the sheet P between the secondary transfer unit 3 and the fixing roller pair 5. The value of Te has been preset in the memory 18.

The reversed loop soon reaches the second loop detecting sensor S2 as illustrated in FIG. 10 mentioned above. After that, by repeating the operating steps similar to those in the normal loop, the loop amount of the sheet P between the secondary transfer unit 3 and the fixing roller pair 5 can be held to L2 and the conveyance of the sheet P is stabilized.

As mentioned above, after the fixing entrance sensor R detected the sheet, if the first loop detecting sensor S1 does not detect the loop of the sheet P, the sheet conveying speed of the fixing roller pair 5 is controlled so as to reduce the loop amount of the sheet.

Thus, the occurrence of the reverse loop of the sheet P between the secondary transfer unit 3 and the fixing roller pair 5 can be prevented. Consequently, the increase in size is avoided and the curled sheet can be conveyed at low costs without causing the defective image such as image rubbing or the like. A degree of freedom of the layout construction of the conveying path 53 in the image forming apparatus 100 and the component parts and the like of the image forming apparatus 100 can be raised.

Although the case of controlling the sheet conveying speed of the fixing roller pair 5 for the loop control has been described above, it is sufficient that a difference between the sheet conveying speed of the fixing roller pair 5 and that of the secondary transfer unit 3 can be controlled. Therefore, if the first loop detecting sensor S1 does not detect the loop of the sheet P, it is sufficient to control the sheet conveying speed of at least one of the fixing roller pair 5 and the secondary transfer unit 3.

The above description has been made on the assumption that in order to decrease the reverse loop of the sheet P, the setting time Te during which the fixing roller pair 5 is driven at the sheet conveying speed Vfh higher than that of the secondary transfer unit 3 is determined based on the count value of the timer 14 which has previously been calculated. However, if the decrease in the reverse loop of the sheet P can be detected, for example, a change position detecting unit which can detect the loop shape of the sheet may be provided between the fixing roller pair 5 and the secondary transfer unit 3. In such a case, the sheet conveying speed of the fixing roller pair 5 is changed to Vf1 (rotational speed Mh of the fixing motor M) for the time set based on the detection of the loop of the sheet P by the change position detecting unit.

Although the first loop detecting sensor S1 for discriminating whether the loop of the sheet is the normal loop or the reverse loop and the second loop detecting sensor S2 for making the loop control have been provided on the normal loop side in the embodiment, the first loop detecting sensor S1 can also function as a second loop detecting sensor S2 in common. That is, the first loop detecting sensor S1 has a role of discriminating whether the loop of the sheet is the normal loop or the reverse loop and a role of making the loop detection for switching the sheet conveying speed of the fixing roller pair 5 to one of the high speed and the low speed (role of the second loop detecting sensor S2). With such a construction, an effect of reducing the costs is obtained.

The first loop detecting sensor S1 can also function as a fixing entrance sensor R in common.

Figure 16:
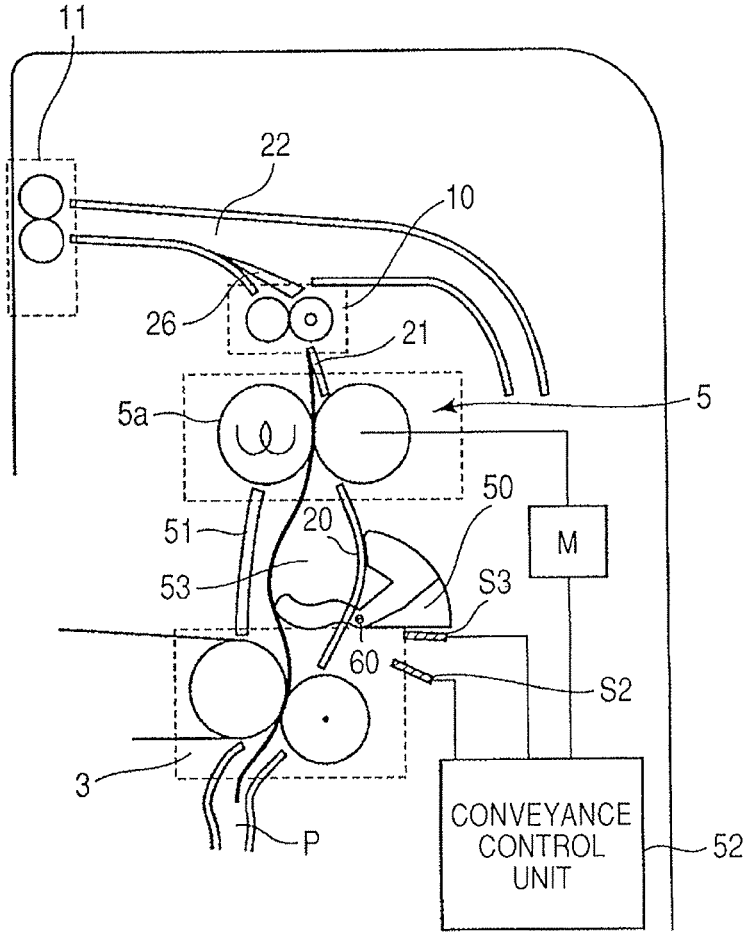
FIG. 16 is an enlarged diagram of a main section of an image forming apparatus according to the second embodiment of the invention.

FIG. 16 is an enlarged diagram of a main section of an image forming apparatus according to the second embodiment of the invention in which the first loop detecting sensor S1 also functions as a fixing entrance sensor R in common. In FIG. 16, the same or similar component elements as those in FIG. 2 mentioned above are designated by the same reference numerals. The fundamental operations are substantially the same as those in the first embodiment.

In FIG. 16, the first loop detecting unit S3 also functioning as a fixing entrance sensor is illustrated. As already mentioned above, when the sheet P enters the conveying path 53, first, the flag 50 is pressed and rotated and light-shields the first loop detecting unit S3. Thus, the first loop detecting unit S3 detects the sheet.

Figure 17:
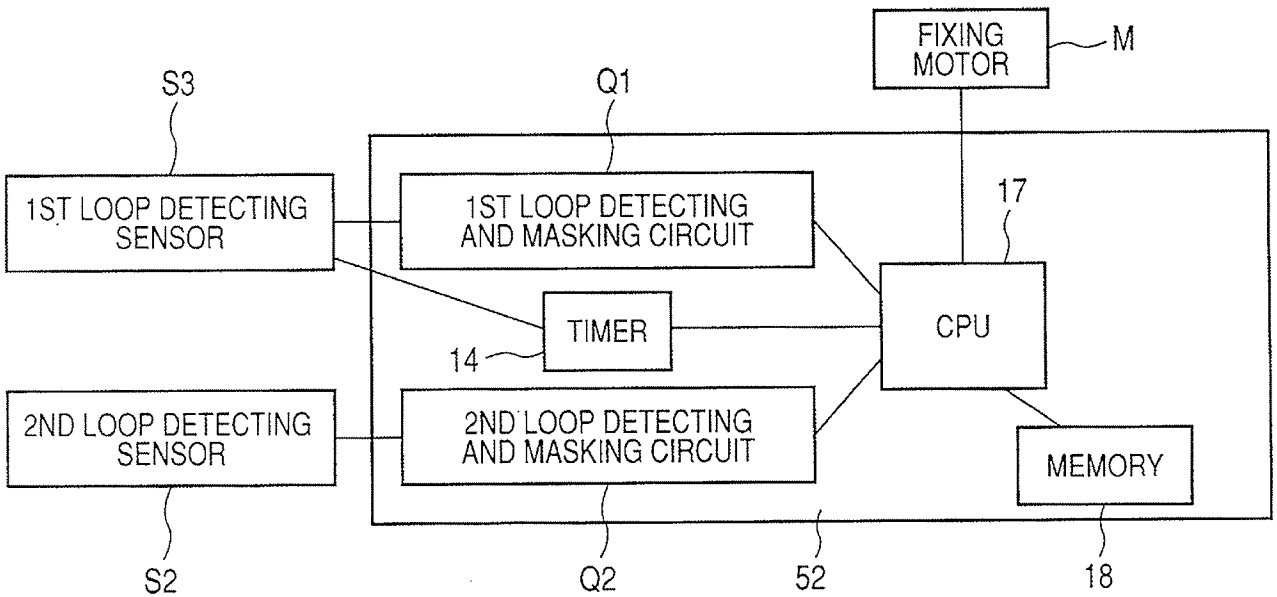
FIG. 17 is a control block diagram of a conveyance control unit provided in the image forming apparatus.

As illustrated in FIG. 17, the first loop detecting unit S3 is connected to the conveyance control unit 52. When the first loop detecting unit S3 detects the sheet as mentioned above, the conveyance control unit 52 starts the counting operation of the timer 14.

Subsequently, the sheet P reaches the fixing nip of the fixing roller pair 5 whose sheet conveying speed has been preset to Vf1 lower than the sheet conveying speed Vt of the secondary transfer unit 3. At this time, the rotational speed of the fixing motor M is equal to M1 as shown in (b) in a timing chart of FIG. 18.

After that, the sheet P is nipped by the fixing roller pair 5 and the loop is formed in the sheet P in the conveying path 53 between the secondary transfer unit 3 and the fixing roller pair 5. At this time, if the sheet P is curled, the reverse loop is formed in a manner similar to that in the foregoing first embodiment (refer to FIG. 13).

Figure 18:
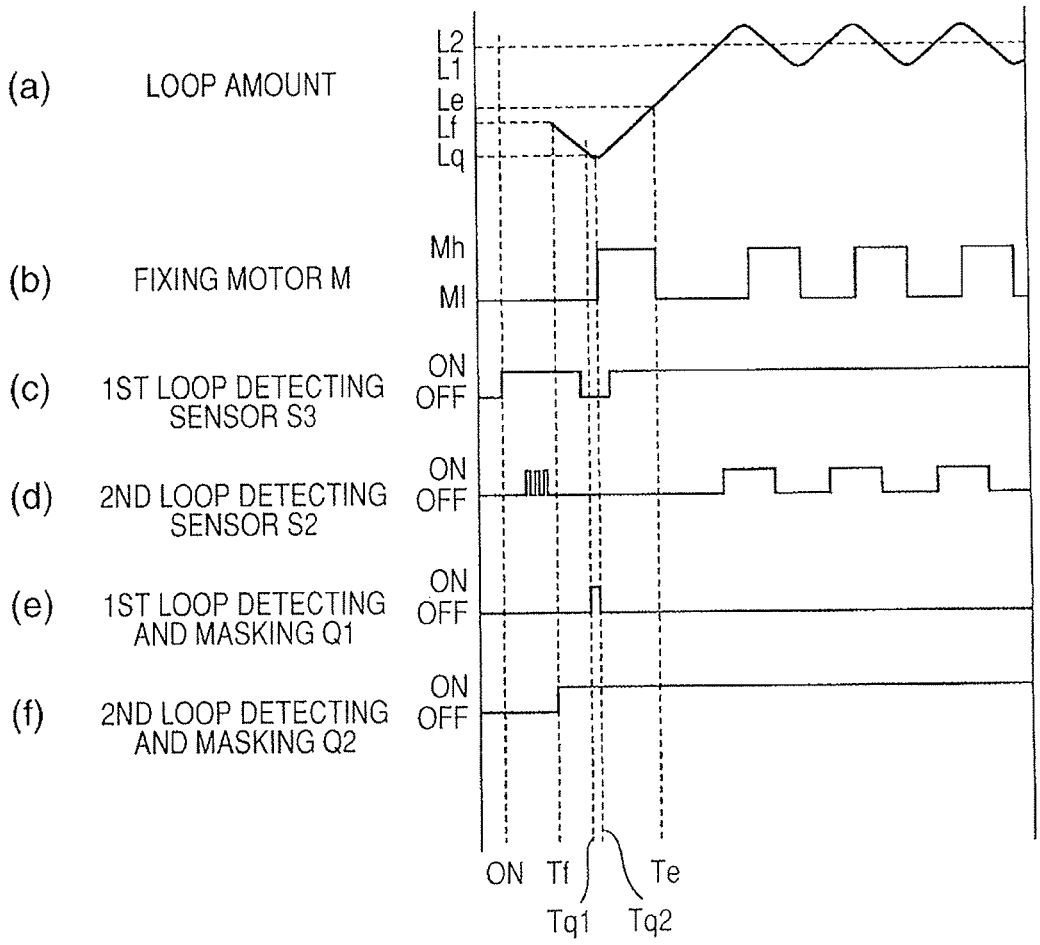
FIG. 18 is a timing chart for describing the loop control operation of the conveyance control unit.

On the other hand, as shown in (e) in FIG. 18, the first loop detecting and masking circuit Q1 is held in the OFF state. However, when the count value of the timer 14 at this time reaches Tq1, the first loop detecting and masking circuit Q1 is held in the ON state until the count value reaches Tq2. For this period of time (Tq1 to Tq2), when the first loop detecting sensor S3 outputs an ON signal, the ON signal is input to the conveyance control unit 52.

However, in this case, the first loop detecting sensor S3 is OFF as shown in (c) in FIG. 18. Therefore, the conveyance control unit 52 determines that the loop is the reverse loop, and switches the rotational speed of the fixing motor M from M1 to Mh as shown in (b) in FIG. 18. At this time, a condition of the set values of Tq1 and Tq2 is the timing when the first loop detecting sensor S3 is certainly turned on at the time of the normal loop. The values of Tq1 and Tq2 have been set in the memory 18.

After that, the fixing motor M is driven at the rotational speed Mh and the sheet P is conveyed from the fixing roller pair 5 at the sheet conveying speed Vfh for the setting time Te from the timer 14. After the sheet was conveyed for the setting time Te, the sheet conveying speed Vf of the fixing roller pair 5 is again returned to the speed Vf1 (rotational speed M1 of the fixing motor M) lower than the sheet conveying speed Vt of the secondary transfer unit 3.

Although the loop Le is in the loop state of the slightly opposite side (refer to FIG. 15) at the timing Te, it is in the state where the reverse loop is smaller than the loop Lf in the state of Tf illustrated in FIG. 11 mentioned above. Therefore, the loop of the sheet P does not form the reverse loop again but can be reversed to the side (side shown by the arrow X) which is formed by the nip angle $\phi$ between the secondary transfer unit 3 and the fixing roller pair 5, thereby forming the normal loop.

A condition of the set value of Te at this time is the timing of forming such a shallow reverse loop state that the loop can be reversed in the normal loop orientation without stretching the sheet P between the secondary transfer unit 3 and the fixing roller pair 5. The value of Te has been preset in the memory 18.

The reversed loop reaches the second loop detecting sensor S2. Thereafter, by repeating the operating steps similar to those in the normal loop, the loop amount of the sheet P between the secondary transfer unit 3 and the fixing roller pair 5 can be held to L2 and the conveyance of the sheet P is stabilized.

Thus, according to the embodiment, in a manner similar to the foregoing first embodiment, even if the reverse loop occurs, the occurrence of the defective image such as image rubbing or the like can be prevented. Further, since the first loop detecting sensor S3 also functions as a fixing entrance sensor (sheet detecting unit), the further reduction of the costs and space can be realized.

The third embodiment of the invention will now be described.

Figure 19:
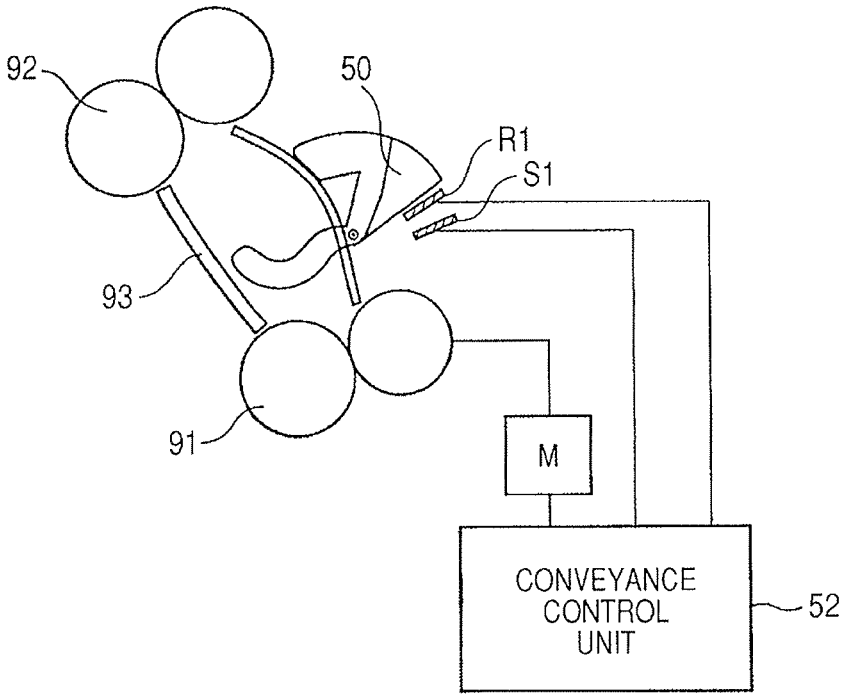
FIG. 19 is an enlarged diagram of a main section of an image forming apparatus according to the third embodiment of the invention.
Figure 20A:
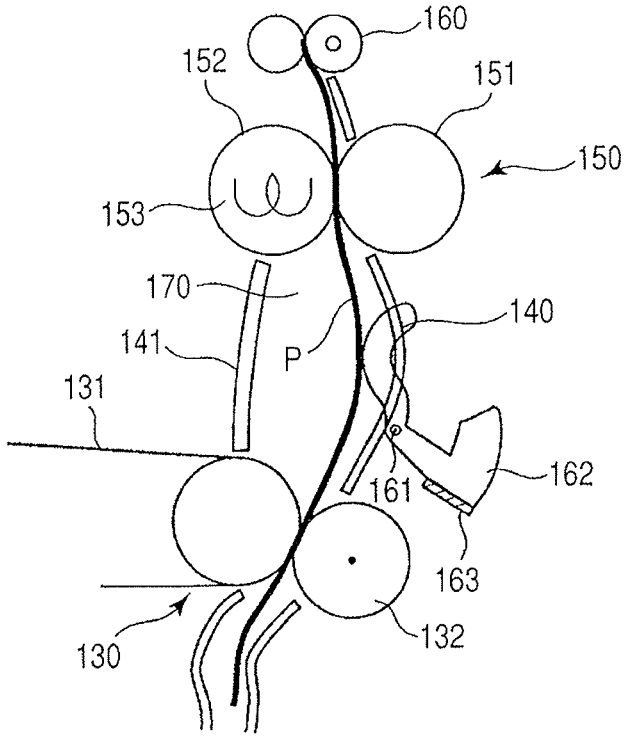
FIGS. 20A and 20B are diagrams for describing the loop control operation of an image forming apparatus having a conventional sheet conveying apparatus.
Figure 20B:
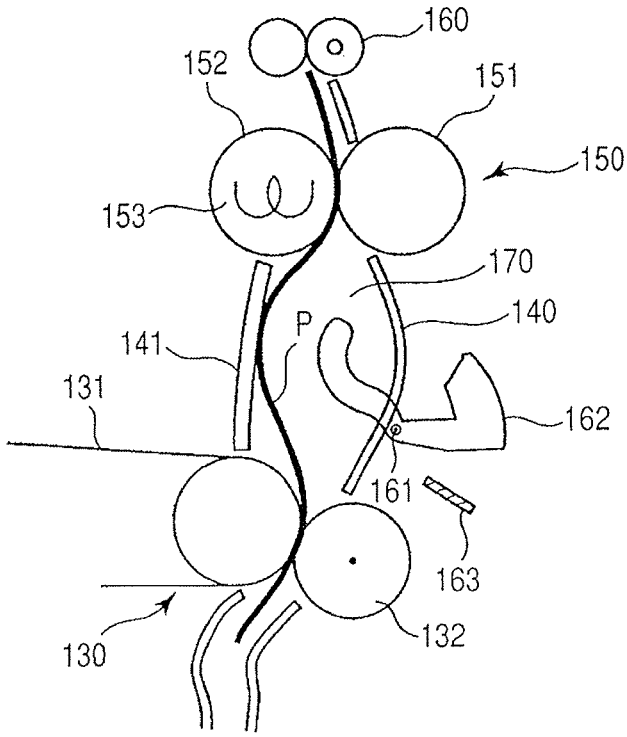

FIG. 19 is an enlarged diagram of a main section of an image forming apparatus according to the third embodiment. In FIG. 19, the same or similar component elements as those in FIG. 2 mentioned above are designated by the same reference numerals.

In FIG. 19, an upstream sheet conveying unit 91, a downstream sheet conveying unit 92, and a sheet detecting unit R1 are illustrated. The conveyance control unit 52 controls a sheet conveying speed of the upstream sheet conveying unit 91, thereby adjusting the loop of the sheet between the upstream sheet conveying unit 91 and the downstream sheet conveying unit 92. When a front edge of the sheet P presses the flag 50, the flag 50 is rotated and light-shields the first sheet detecting unit R1, so that the conveyance control unit 52 starts the counting operation of the timer. After that, if the first loop detecting sensor S1 is not turned on even after the elapse of a predetermined time, the conveyance control unit 52 determines that the loop is the reverse loop, and controls the motor M so as to reduce the sheet conveying speed of the upstream sheet conveying unit 91. Thus, the loop amount of the sheet decreases and the loop in the normal orientation is formed. Since the control for returning the reverse loop is substantially the same as that in one of the first and second embodiments mentioned above, its detailed description is omitted.

In the case of the construction of the embodiment 3, for example, a large effect is obtained when the upstream sheet conveying unit 91 is the fixing unit and the downstream sheet conveying unit 92 is the discharging and conveying unit. In other words, since the sheet just after the fixing is in the high-temperature state, the toner on the image surface is in the fused state. In this instance, if the image surface is come into contact with a guide 93, a temperature change state on an image rubbing trace and a temperature change state at a position other than the guide contact position differ, so that a glossiness variation occurs.

For such a problem, by constructing as shown in the embodiment 3, the occurrence of the reverse loop of the sheet P can be prevented. Therefore, the occurrence of the image rubbing trace and the glossiness variation can be prevented.

The embodiment is not limited to the above construction but, for example, the counting operation of the counter for discriminating the reverse loop can be also started based on the timing for feeding out the sheet by the registration roller 9 in place of the fixing entrance sensor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-135891, filed May 15, 2006, which is hereby incorporated by reference herein in its entirety.

What is claimed is:

1. An image forming apparatus comprising:

a first sheet conveying unit which conveys a sheet;

a second sheet conveying unit which is provided downstream of the first sheet conveying unit and conveys the sheet;

a loop detecting unit which detects the sheet whose loop is formed between the first sheet conveying unit and the second sheet conveying unit; and a control unit which controls a sheet conveying speed of at least one of the first sheet conveying unit and the second sheet conveying unit so as to form the loop during the sheet conveyance process, wherein the control unit includes a memory in which is set a presumption time, the presumption time approximating a time period from when a leading edge of a sheet has first arrived at the second sheet conveying until when it is presumed that the loop detecting unit will have detected a sheet whose loop is formed, wherein when the presumption time has elapsed, if the loop detecting unit has not yet detected a loop, the control unit controls the sheet conveying speed so as to reduce an amount of a loop which is formed in the sheet until an elapse of a setting time previously set, and wherein when the presumption time has elapsed, if the loop detecting unit has detected a loop, the control unit controls the sheet conveying speed so as to convey the sheet while keeping an amount of the detected loop which is formed in the sheet in a predetermined range.

2. An apparatus according to claim 1, further comprising a sheet detecting unit which detects the sheet which enters between the first sheet conveying unit and the second sheet conveying unit, and wherein the presumption time is set by using the detection of the sheet by the sheet detecting unit as a reference.

3. An apparatus according to claim 1, wherein the loop detecting unit can detect the sheet which enters between the first sheet conveying unit and the second sheet conveying unit, and the presumption time is set by using the detection of the entering sheet by the loop detecting unit as a reference.

4. An apparatus according to claim 1, wherein the first sheet conveying unit and the second sheet conveying unit are arranged so that a sheet conveying direction of the first sheet conveying unit and a sheet conveying direction of the second sheet conveying unit cross, a conveying path is bent so that the loop is formed in the sheet in a predetermined normal orientation, and if the loop is formed in the sheet in the orientation opposite to the normal orientation, the amount of the loop which is formed in the sheet is reduced based on a recovery time which is previously calculated for reducing the loop amount of the sheet until the state where the orientation of the loop of the sheet is changed to the normal orientation.

5. An apparatus according to claim 4, further comprising a changing position detecting unit which detects the state where the orientation of the loop of the sheet is changed to the normal orientation when the loop is formed in the sheet in the opposite orientation, and wherein the recovery time for reducing the amount of the loop of the sheet is set based on the detection of the changing position detecting unit.

6. An apparatus according to claim 1, wherein based on the detection of the loop detecting unit, the control unit makes control at a high speed adapted to make the sheet conveying speed of the second sheet conveying unit higher than that of the first sheet conveying unit and control at a low speed adapted to make the sheet conveying speed of the second sheet conveying unit lower than that of the first sheet conveying unit.

7. An apparatus according to claim 1, wherein the first sheet conveying unit is a transfer unit which transfers an image onto the sheet by an image forming unit, and the second sheet conveying unit is a fixing unit which fixes the image transferred to the sheet by the transfer unit.

8. An apparatus according to claim 1, wherein the first sheet conveying unit is a fixing unit which fixes an image transferred to the sheet by an image forming unit, and the second sheet conveying unit is a discharging unit which discharges the sheet on which the image has been fixed by the fixing unit.

* * * * *